US007240870B2

(12) United States Patent
Lammers et al.

(10) Patent No.: US 7,240,870 B2
(45) Date of Patent: Jul. 10, 2007

(54) PORTABLE HAND-HELD PAPER SHREDDER

(75) Inventors: Anthony J. Lammers, Gates Mills, OH (US); John R. Nottingham, Bratenahl, OH (US); John W. Spirk, Gates Mills, OH (US); Jeffrey Scott Plantz, Cleveland, OH (US); Patrick W. Brown, Auburn, OH (US)

(73) Assignee: InnoDesk Business Tools, Inc., Beachwood, OH (US)

( * ) Notice: Subject to any disclaimer, the term of this patent is extended or adjusted under 35 U.S.C. 154(b) by 64 days.

(21) Appl. No.: 11/043,419

(22) Filed: Jan. 25, 2005

(65) Prior Publication Data

US 2005/0211807 A1 Sep. 29, 2005

Related U.S. Application Data

(63) Continuation of application No. PCT/US03/23476, filed on Jul. 28, 2003.

(60) Provisional application No. 60/398,755, filed on Jul. 26, 2002.

(51) Int. Cl.
*B02C 18/16* (2006.01)

(52) U.S. Cl. ..... 241/167; 241/169.2; 241/236

(58) Field of Classification Search ..... 241/236, 241/169.1, 166, 167, 36
See application file for complete search history.

(56) References Cited

U.S. PATENT DOCUMENTS 1,090,914 A 3/1914 Güettler
3,286,574 A 11/1966 Durand
4,869,435 A 9/1989 Pistorius et al.
5,054,695 A 10/1991 Koornhof
5,071,080 A 12/1991 Herbst et al.
5,230,477 A 7/1993 Strohmeyer
5,511,732 A 4/1996 Kroger et al.
5,826,809 A 10/1998 Kroger
5,839,675 A 11/1998 Henreckson et al.
5,853,131 A 12/1998 Cheng
5,961,059 A 10/1999 Kroger

FOREIGN PATENT DOCUMENTS

JP 10118513 5/1998

*Primary Examiner*—Mark Rosenbaum
(74) *Attorney, Agent, or Firm*—Keevican Weiss Bauerle & Hirsch LLC

(57) ABSTRACT

A hand-held device for shredding paper comprising a pair of rotary cutting wheels disposed within a housing between an inlet slot and an outlet slot. A motor is positioned in the handle to drive the cutting wheels through a gear assembly. One wheel serves as a drive wheel, which is coupled directly to the gear assembly, and the other wheel serves as an idler, driven from a spur gear attached to the drive wheel at the end opposite a gear case. Paper sheets are fed into the inlet slot and pulled between the wheels. Wheels are comprised of a stack of alternating discs of a large and small radius, and staggered so as to allow the two wheels to be interleaved while rotating in opposite (clockwise and counterclockwise) directions and maintain clearance. Large discs have a frictional edge to grab and feed the paper into the intersection of the wheels, tearing the paper into strips and forcing the strips into the outlet slot. A battery compartment in the handle contains the batteries for energizing the motor.

12 Claims, 8 Drawing Sheets

PORTABLE HAND-HELD PAPER SHREDDER

RELATED APPLICATIONS

This application is a continuation of International Application No. PCT/US03/023476, filed Jul. 28, 2003, entitled "Portable Hand-Held Paper Shredder." That application claimed the benefit of U.S. Provisional Patent Application Ser. No. 60/398,755, filed Jul. 26, 2002, under the same title.

FIELD OF THE INVENTION

This invention relates to paper shredders, and more particularly, to battery-powered, hand-held, portable paper shredders.

BACKGROUND OF THE INVENTION

Due to recent increased incidents of information theft, individuals, as much as businesses, feel the need to destroy financial and personal records in order to protect such confidential information. The security purposes served by shredding documents include prevention of identity theft, credit card and bank fraud, and even espionage.

Electric paper shredders were invented in the 1930s, but for many years, their cost and bulk made them accessible only to corporations and government agencies. In the mid-1980s, paper shredders became more affordable and were designed on a smaller scale to accommodate small office and individual users. These personal shredders were still not economical, though, until in the mid-1990s, prices of paper shredders dropped further, into the "affordable" range. At about that same time, identity theft became common, and the use of personal shredders increased dramatically.

Institutional and even criminal use of paper shredders to destroy sensitive documents and incriminating documentary evidence of wrongdoing has brought the paper shredder even more into public focus when large companies have tried to hide wrongdoing by feverishly shredding documents while a government fraud investigation was underway or about to begin.

When individuals shred their sensitive documents and throw the shredding out with their other garbage, there are orange peels and coffee grounds mixed in with the shreddings. Identity thieves are thus frustrated in their efforts to piece together documents that have been shredded.

Therefore, there exists a need for a lightweight, hand-held, battery-powered paper shredder that is convenient to use and compact for storage in a desk drawer or on a desktop.

SUMMARY OF THE INVENTION

A hand-held device for shredding paper comprises a housing having a handle portion and a shredding portion. The shredding portion has an elongated inlet aperture and an elongated outlet aperture, with a pair of rotating wheel assemblies disposed intermediate the inlet and outlet apertures. Each wheel assembly has means integral to the assembly for frictionally engaging one or more sheets of paper. The handle contains a drive means for imparting rotational motion to the rotating wheel assemblies. The rotating wheel assemblies are each comprised of a plurality of wheels, comprising cutting wheels and spacer wheels in axially alternating positions along a rod. The cutting wheels and spacer wheels are staggered relative to the opposing wheel assemblies to permit cutting wheels to interleave between wheel assemblies and to maintain clearance to permit cooperating rotation.

DETAILED DESCRIPTION OF THE INVENTION

Figure 1:
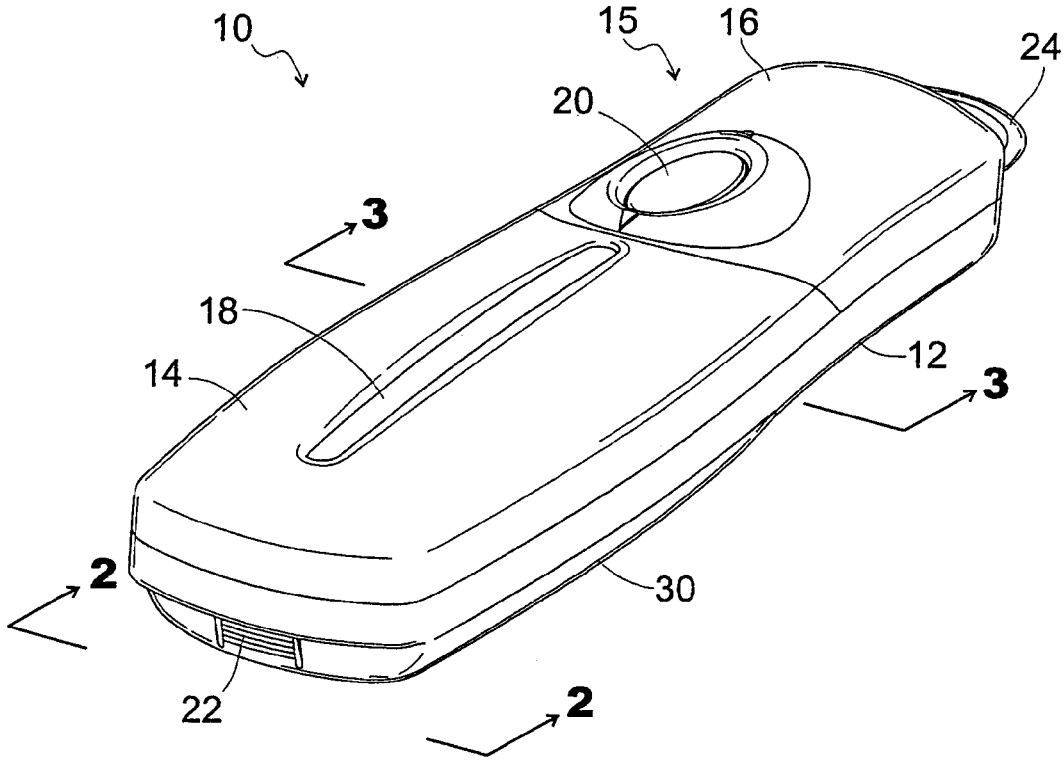
FIG. 1 is a perspective view of a hand-held paper shredder.

Referring first to FIG. 1, a hand-held paper shredder is generally designated as 10. Shredder 10 includes a bottom shell portion 12 and two interlocking top shell portions 14, 16. The first top shell portion 14 includes a first elongated aperture 18 into which one or more sheets of paper may be inserted for shredding. A second elongated aperture 18*a* (not shown) is disposed opposite first elongated aperture in a battery compartment cover 30. Second top shell portion 16 includes a slideable, spring-maintained, momentary reversing switch 20. Switch 20 may also be a pushbutton type switch. A raised collar 21 surrounds the switch 20. The raised collar 21 projects upward slightly beyond the raised portion of switch 20, so that the switch 20 will not be accidentally operable when laid on a surface with the switch facing down. Battery compartment cover 30 attaches to bottom shell portion 12 to conceal the batteries within. The battery compartment cover 30 is releasable by depressing a release tab 22 and pulling away from the bottom shell portion 12.

Figure 2:
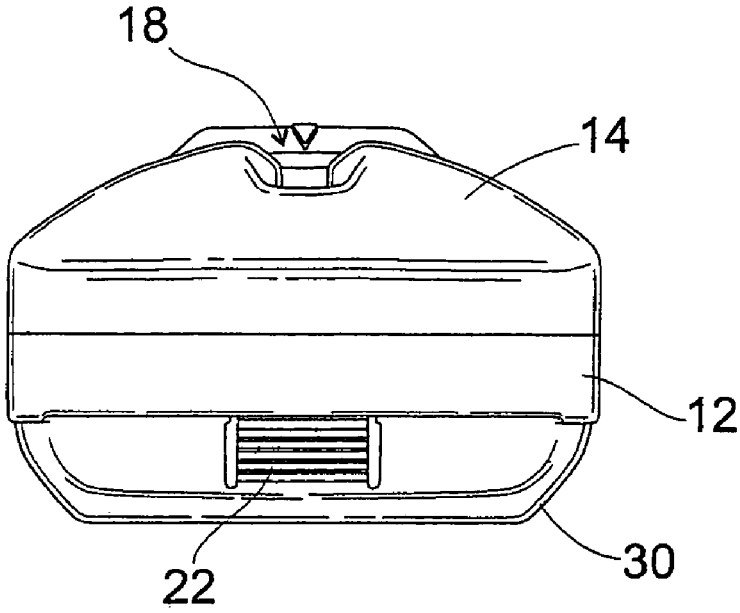
FIG. 2 is an elevational view taken along the lines 2-2 in FIG. 1.

Referring next to FIG. 2, an end view of the shredder 10 is shown. First top shell portion 14 is attached to bottom shell portion 12 and battery compartment cover 30 attaches to bottom shell portion 12. The corrugated release tab 22 is disposed centrally of the battery compartment cover 30. Aperture 18 is shown at the apex of the curvature of first top shell portion 14.

Figure 3:
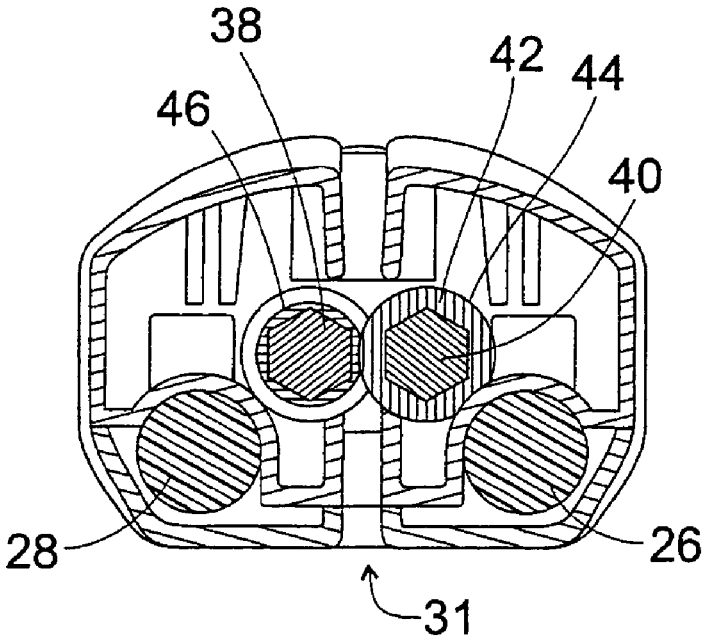
FIG. 3 is a cross-sectional view taken along the lines 3-3 in FIG. 1.

Referring next to FIG. 3, a cross-sectional view through the shredder shows two of the four batteries 26, 28 situated in the battery compartment adjacent to shredder wheel assemblies 38, 40. Cutter wheels 44 define the outermost perimeter of large spacer wheels 42. Small spacer wheels 46 are juxtaposed with the large spacer wheels 42 so as to permit the adjacent shredder wheel assemblies 38, 40 to interleave in a partially overlapping cross section, while maintaining clearance to rotate freely on the wheel assemblies 38, 40.

The adjacent shredder wheel assemblies 38, 40 are spaced apart a distance less than the radius of the large spacer wheels 42 and greater than the radius of small spacer wheels 46.

Figure 4:
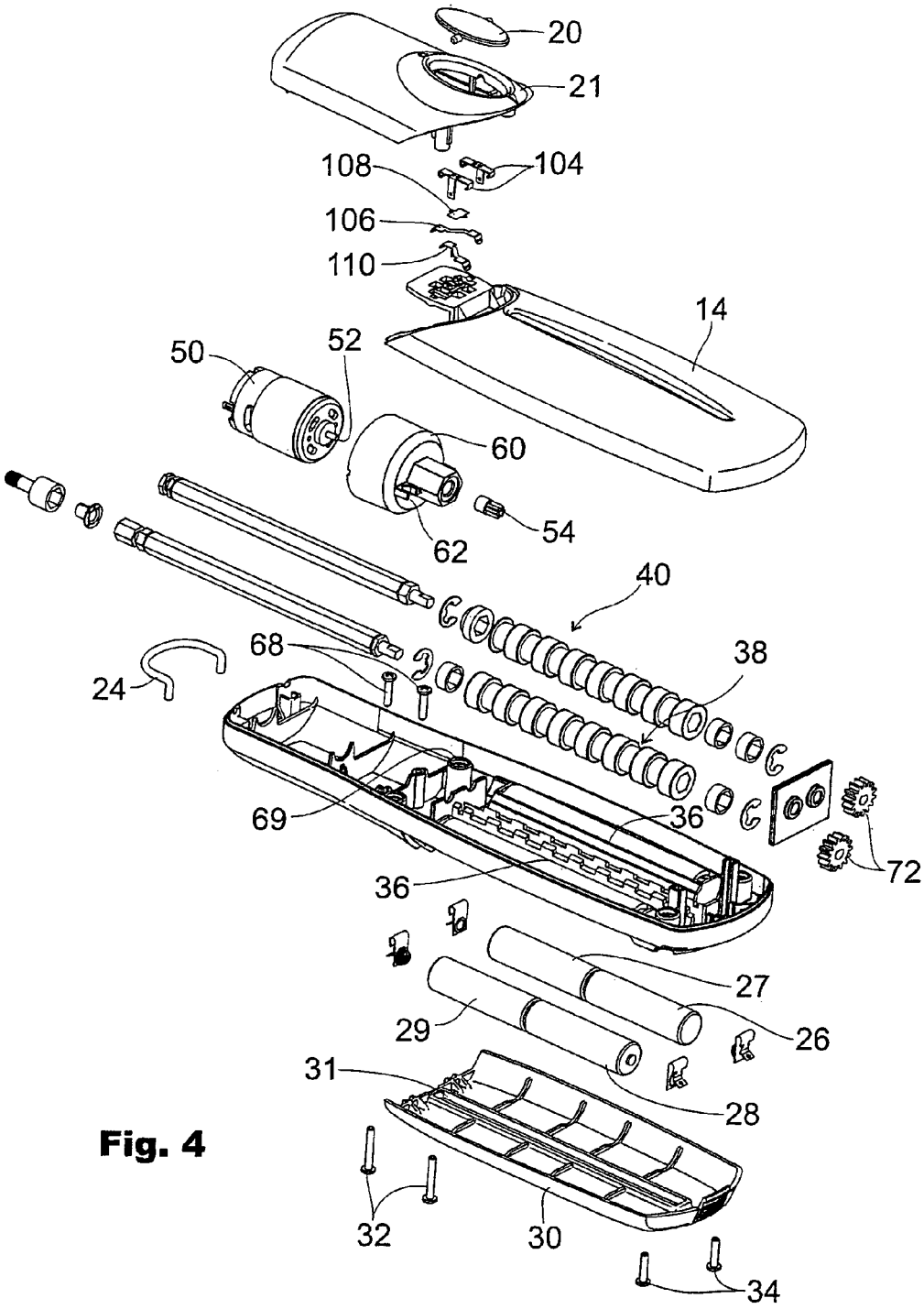
FIG. 4 is an exploded view of the hand-held paper shredder.
Figure 5:
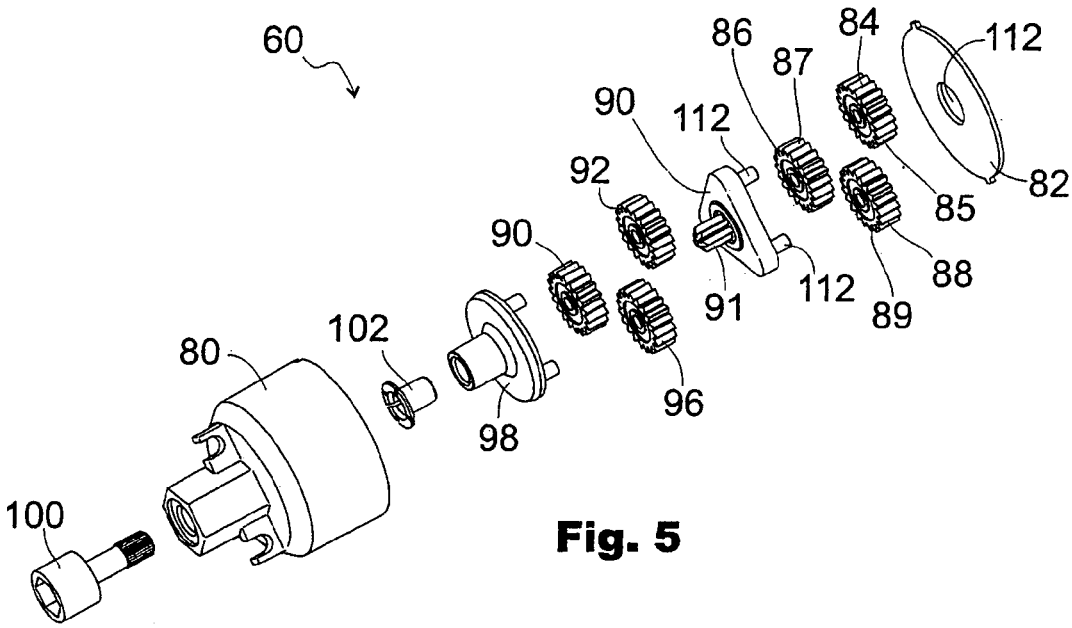
FIG. 5 is an exploded view of the gearbox assembly.
Figure 6:
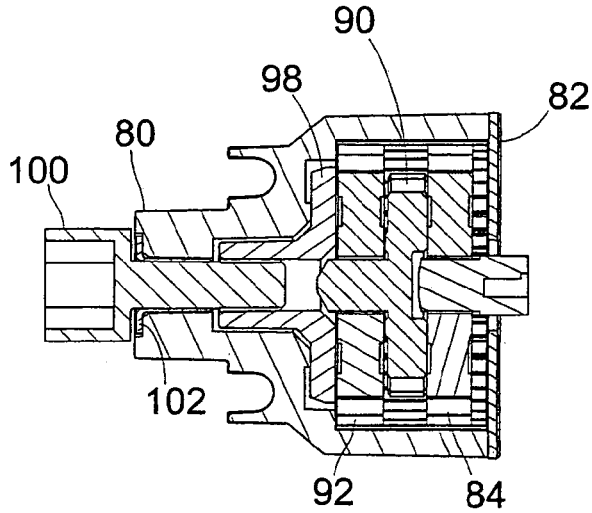
FIG. 6 is a cross-sectional view of the gearbox assembly.

Referring next to FIGS. 4, 5, and 6, an exploded view illustrates the order in which the parts are assembled. Four batteries 26, 27, 28, 29 are disposed on the bottom portion of paper shredder 10 and enclosed when battery compartment cover 30 is attached to the bottom shell portion 12. The bottom shell portion 12 provides a support frame for the rotating parts of the shredder 10. Also, teeth 36 are positioned adjacent to shredder wheel assemblies 38, 40 at the junction of the two shredder assemblies 38, 40 to scrape the surfaces of wheels 42, 46 as they rotate. The teeth 36 scrape away any shreddings that cling to the wheel surfaces 42, 46, and direct them into the second elongated aperture to be discharged to prevent paper shreds from clogging in the housing and restricting the rotational movement of first and second shredder wheel assemblies 38, 40.

A small DC electric motor 50 is disposed in the end of handle or bottom shell portion 12 beneath second top shell portion 16. A shaft 52 of motor 50 is inserted into a drive shaft 54 having a knurled, straight-molded end portion. Drive shaft 54 is inserted into a gearbox subassembly 60 to couple the motor 50 with the gearbox subassembly. The gearbox subassembly 60 has mounting frame portions 62 on either side of the drive axis in order to fasten the gearbox subassembly 60 to the bottom shell portion 12. A pair of screws 68 is threaded into corresponding mounting stands 69 to secure the motor 50 and gearbox subassembly 60. The shredder wheel is the drive shaft and is connected to a drive shaft extension 100. The first shredder wheel 64 is the drive wheel, which is coupled directly to gearbox subassembly 60 through drive shaft 100 at one end. At the opposite end, the first shredder wheel is coupled to a first spur gear 70, which is engaged with a second spur gear 72. Second spur gear 72 is, in turn, coupled to the second shredder wheel, which is also referred to as an idler, which rotates when a drive shredder wheel 64 rotates through coupling with the motor 50. When the driver first shredder wheel 38 (also referred to as the "drive wheel") is rotated in a counterclockwise direction, first spur gear 70 drives second spur gear 72. Spur gear 72 is attached to second (or "idler") shredder wheel 40. Spur gear 72 simultaneously drives idler shredder wheel assembly 40 in a clockwise direction. A junction 48 of the idler 40 and drive 38 wheel assemblies is positioned directly below and central of elongated aperture 18, so as to urge a sheet of paper in the downward direction toward a battery compartment cover aperture 31 and out of the shredder. Junction 48 is non-linear, forming a square-wave profile, causing the sheets of paper, when introduced into the elongated aperture 18, to be pulled in opposite directions at each segment along the square wave junction 48. Thus, the paper is shredded into narrow strips corresponding approximately to the width of the individual spacer wheels 42, 46 of the assemblies, 38, 40.

The bottom shell portion 12 is attached to the first top shell portion 14 by means of two pairs of screws 32, 34 projecting through the mounting stands 69 and into receptacles (not shown) on first top shell portion 14.

The rocker switch 20 includes contact portions 104, an upper contact portion 106, a lower contact portion 110, and an insulator sheet 108 disposed between upper and lower contact portions 106, 110.

FIG. 5 illustrates an exploded view of the gearbox assembly, generally designated as 60. A retainer disc 82 acts as a grease seal between the face of the motor 50 and the gearbox assembly 60. An aperture 116 in disc 82 is adapted to receive the end of the drive shaft 54 into engagement with three planetary gears 84, 86, 88 arranged concentrically on a first reduction pinion 90. Apertures 85, 87, 89 and planetary gears 84, 86, 88 are attached to and rotate about three raised portions 112 (only one shown), which rotate within a gearbox housing 80 to turn a pinion gear 91. Pinion gear 91 engages a second set of planetary gears 92, 94, 96 also meshing concentrically, so as to rotate a second reduction pinion 98. The planetary gears 92, 94, 96 are coupled to second reduction pinion 98 by a raised portion 114. When planetary gears 92, 94, 96 rotate, second reduction pinion 98, in turn, rotates, causing the drive shaft extension 100 to turn the shredder wheel assemblies 38, 40. Preferably, a bushing 102 is inserted in the end of gearbox housing 80 to absorb wear caused by rotation.

FIG. 6 is a center cross-sectional view of the gearbox subassembly 60, showing the arrangement of the gearbox subassembly in the assembled state.

Figure 7:
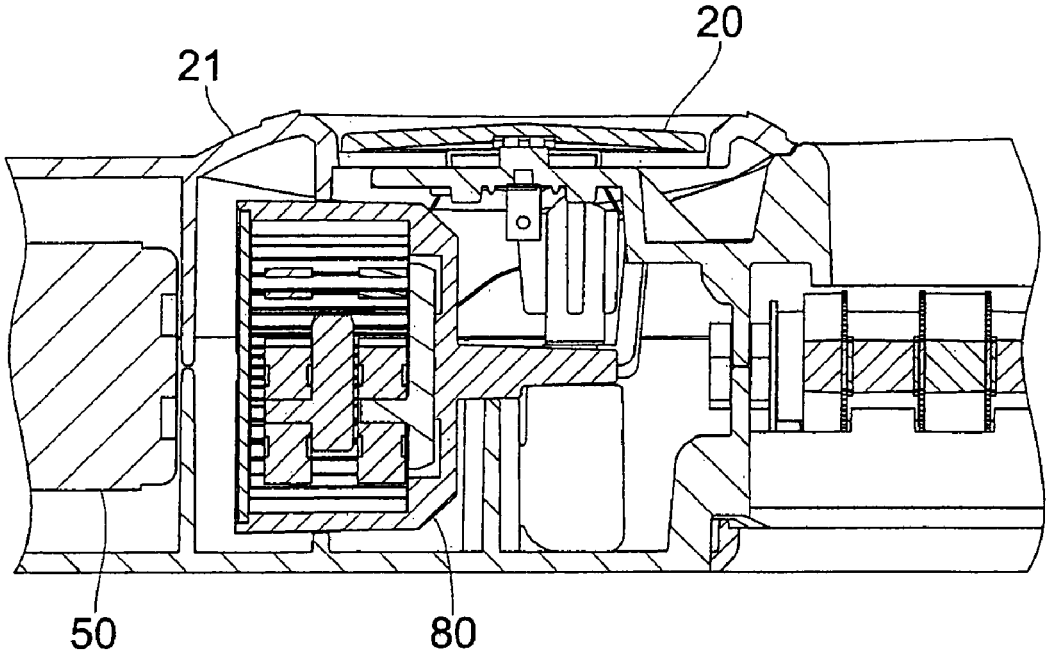
FIG. 7 is a fragmentary sectional view of the motor and gearbox assembly connection to the shredder wheels.
Figure 8:
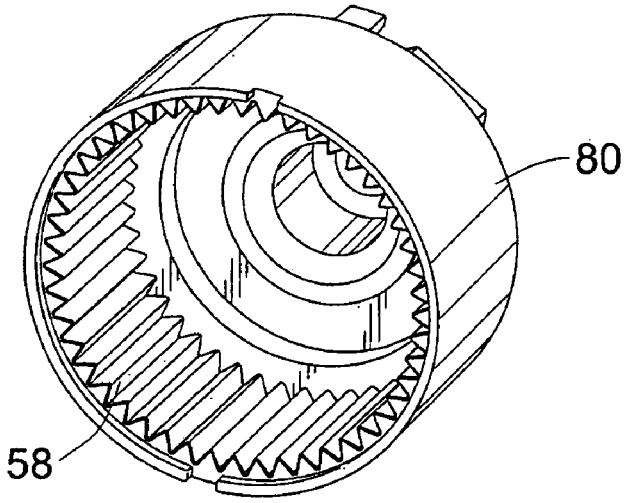
FIG. 8 is a perspective rear view of the gear housing.

Referring next to FIG. 7, a reverse angle of the gearbox housing is shown illustrating interior teeth 58, which cooperate with the planetary gears to cause rotation of the first and second pinions 90, 98 and to achieve the desired speed reduction between the motor 50 and shredder wheel assemblies 38, 40.

Figure 9:
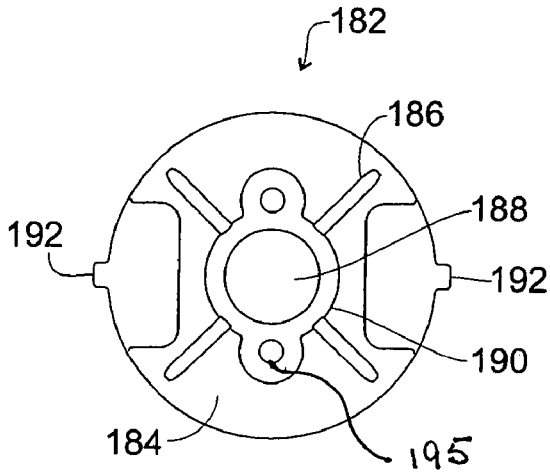
FIG. 9 is a plan view of the coupling/grease retainer.
Figure 10:
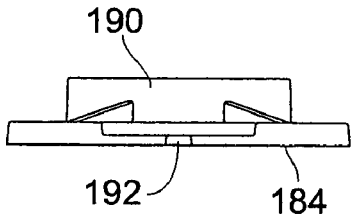
FIG. 10 is a side view of the coupling/grease retainer.

Referring next to FIGS. 9 and 10, an alternate arrangement for the retainer disc is shown. A retainer disc 182 includes a cylindrical hub 190 mounted on a flange 184. Web portion 186 connects hub 190 to flange 184, to provide stabilization and reinforcement. The retainer has a hollow axial bore 188, into which the motor shaft extends. A pair of alignment tabs 192 interlock with complementary recesses (not shown) in the face of the motor, for preventing rotation of the retainer disc relative to the motor shaft. The shaft fits snugly inside the bore 188 to properly align the motor shaft with the gear train. A pair of screw holes 195 are drilled through the retainer disc for fastening the disc to the face of the motor.

Figure 16:
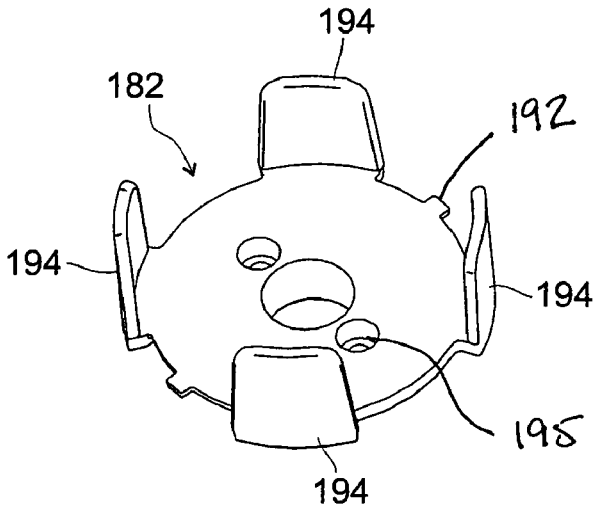
FIG. 16 is an alternate arrangement of a coupling retainer.
Figure 11:
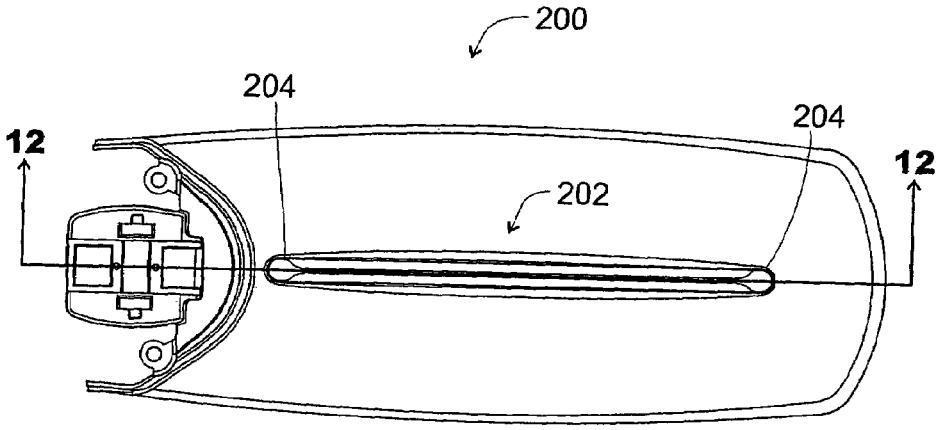
FIG. 11 is a plan view of the top portion of the housing showing a modified slot configuration.
Figure 12:
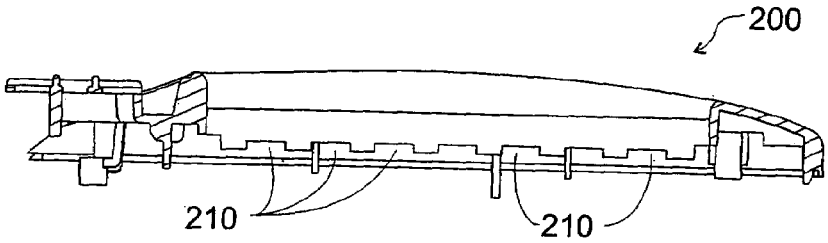
FIG. 12 is a sectional view taken along the lines 12-12 in FIG. 11.
Figure 13:
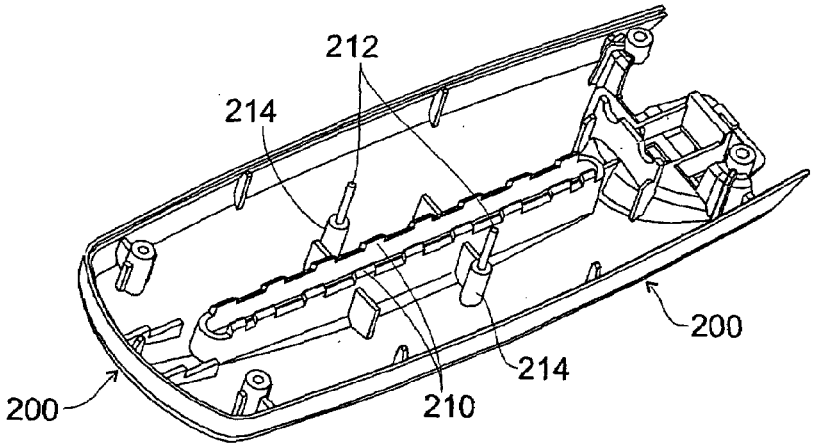
FIG. 13 is a perspective view of the interior of the top housing.
Figure 14:
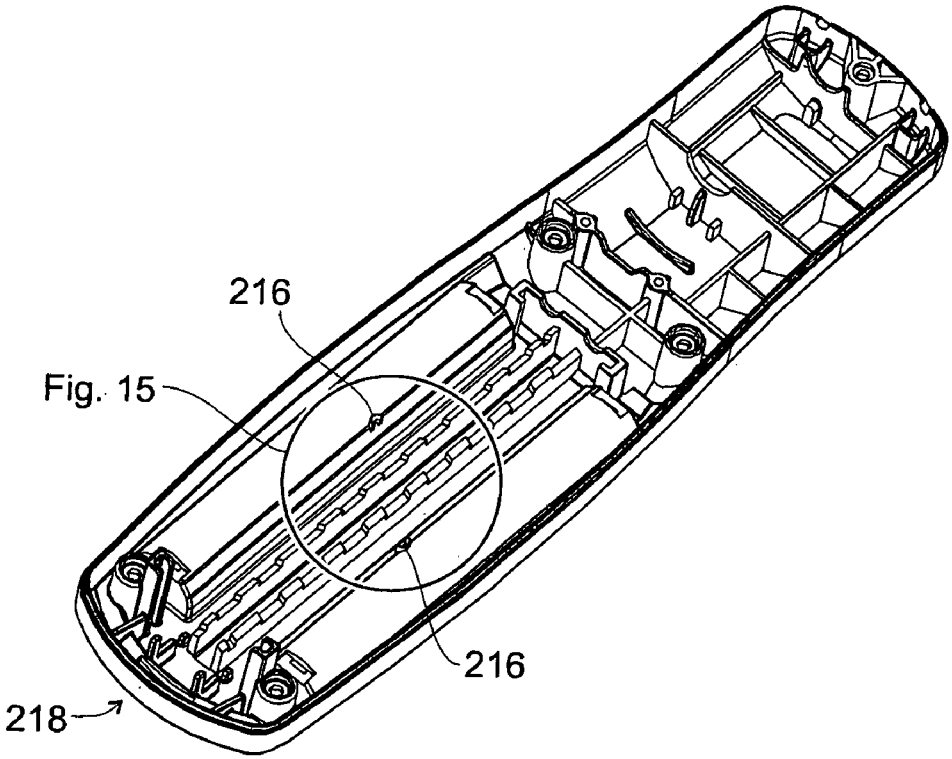
FIG. 14 is a perspective view of the interior of the bottom housing.
Figure 15:
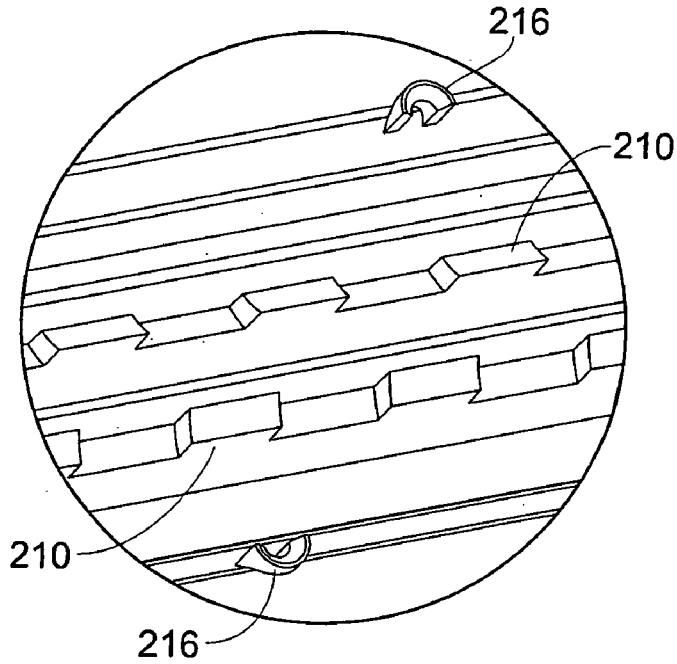
FIG. 15 is a detail of the area designated as 15 in FIG. 14.

FIG. 16 shows yet another alternative arrangement for the retainer disc. In this arrangement, the retainer disc 182 includes a plurality of wing portions 194 as supplementary alignment means between the motor and gearbox. In the embodiment shown in FIG. 16, there are four wings spaced at 90° intervals about the radius. Equidistantly-spaced, more or less, wings may be employed.

Referring next to FIGS. 11-15, the top housing 200 has a modified paper feed slot 202. At either end of the slot 202 is a bulbous opening 204 that tapers to the narrowed feed slot 202. This arrangement prevents the user from feeding paper in excess of the thickness of which the shredder can cut at one time, thereby preventing clogging and jamming. In the preferred embodiment, approximately six to eight sheets of standard weight copy or bond paper will pass easily through the slot 202 for shredding, although by varying the width of the slot and the power rating of the motor, more or less paper can be processed through the shredder. The openings 204 allow the slot 202 to flex slightly, and provide a path for excess material to flow through at the ends, as there is a tendency for paper shreds and fine particles to collect near the ends of the slot 202.

A series of teeth or stripper portions 210 are shown forming a square wave profile on the internal side of the top housing. Stripper portions 210 are positioned adjacent to shredder wheel assemblies on top and bottom sides. Stripper portions are disposed beneath the top side of the housing, in order to strip away shreddings when the motor rotates in the reverse direction. Stripper portions provide an alternate means to clean and prevent jamming of the shredder wheel assemblies, by stripping paper shreddings from the cutting wheels while they rotate. Switch 20 (shown in FIG. 7) is a reversing-type switch capable of switching DC power to the motor in alternating polarity to selectively drive the motor in either clockwise or counterclockwise rotation. When an excessive amount of paper is fed into the feed slot 202, reversing the direction of the motor clears the paper flow path of the shredder by forcing it back out of the slot 202.

Backup pins 212 are metal or plastic pins that serve as travel limits for the shredder wheel assemblies when the rollers flex and separate from an excess amount of paper in the slot. When the thickness of the sheet or sheets becomes too great, the shredder wheel assemblies will try to separate, but will be prevented by the pins 212 from separating any further. The pressure applied against the pins provides additional traction to the paper passing through the slot to aid in pulling the paper through, and ensures that no paper passes through uncut, due to separation between the shredder wheel assemblies (not shown). Pins 212 are retained in place by a pair of hollow bosses 214, having hollow cavities to receive the pins snugly, and to prevent the pins from moving laterally. The opposite end of pins 212 are captured by a pair of semi-circular receptors 216 molded into the bottom housing 218 opposite the bosses 214 in the top housing portion. The semi-circular receptors 216 prevent the pins from moving in the direction of separation, and leaves them free to move inward to release lateral force from the receptors 216 when no pressure is being applied by the shredder wheel assemblies.

The momentary-contact switch on the handle also provides a means for test operation that may be used in the original packaging. The momentary operation of the switch permits the user to operate the device 10 while still wrapped in protective packaging. A transparent thin plastic barrier (not shown) is molded around a portion of the device 10 and adhesively or mechanically attached to a backing sheet of cardboard (also not shown) with the device secured between the plastic barrier and the cardboard. The plastic is pliable so that the pushbutton on the switch may be urged forward to the "ON" position, to turn on the device while on the store shelf. The switch is returned to the "OFF" position when released, thereby avoiding unintended drainage of the batteries in the packages. This advantageous feature invites people to test operate the device.

According to the provisions of the patent statutes, we have explained the principle, preferred construction, and mode of operation of the invention and have illustrated and described what we now consider to represent its best embodiments. However, it should be understood that within the scope of the appended claims and the foregoing description, the invention may be practiced otherwise than specifically illustrated and described.

We claim:

1. A hand-held device for shredding paper comprising:

a housing having a handle portion and a shredding portion;

the shredding portion also having an elongated inlet aperture and an elongated outlet aperture the inlet aperture and the outlet aperture forming a slot through which paper to be shred can pass, said slot including a bulbous opening at each end for flexion and for passing through excess paper shreddings;

a pair of rotating wheel assemblies disposed intermediate said inlet and outlet apertures;

means integral to each said wheel assembly for frictionally engaging one or more sheets of paper;

the handle also having a drive means for imparting rotational motion to said rotating wheel assemblies wherein the drive means includes a motor and a gear reduction means coupled to at least one of said wheel assemblies and wherein the motor, the gear reduction means and the wheel assemblies lie generally along a same longitudinal axis; and a switching means for actuating said drive means.

2. The hand-held device for shredding paper as set forth in claim 1, wherein said rotating wheel assemblies are each comprised of a plurality of wheels, comprising cutting wheels and spacer wheels in axially-alternating positions along a rod, wherein said cutting wheels and spacer wheels are staggered relative to the opposing wheel assemblies to permit cutting wheels to interleave between wheel assemblies and to maintain clearance to permit cooperating rotation.

3. The hand-held device for shredding paper as set forth in claim 1, wherein means for scraping shredded paper from said wheel assemblies is also provided.

4. The hand-held device for shredding paper as set forth in claim 1, wherein a first said wheel assembly is directly coupled to said drive means, and a second said wheel assembly is coupled through a pair of intermediate gears.

5. The hand-held device for shredding paper as set forth in claim 1, wherein a compartment for storage of a power source for said drive means is also provided.

6. The hand-held device for shredding paper as set forth in claim 5, wherein at least one battery in said housing for energizing said motor is also included.

7. The hand-held device for shredding paper as set forth in claim 1, wherein said housing also including two or more restriction devices on opposing sides adjacent to said slot, for preventing the slot from opening more than a predetermined width to retain pressure between the rotating wheel assemblies when feeding excess paper.

8. The hand-held device for shredding paper as set forth in claim 1, wherein said motor is coupled by a hub to said gear reduction means.

9. The hand-held device for shredding paper as set forth in claim 1, wherein said motor is aligned with said gearcase by a retainer having two or more equidistantly-spaced wing portions about the radius in telescoping relation to an end of gear reduction means.

10. The hand-held device, for shredding paper as set forth in claim 1, wherein means for scraping paper from said wheel assemblies when said shredder is operated in the reverse direction is also included.

11. The hand-held device for shredding paper as set forth in claim 1, wherein said switching means includes a reverse position for reversing polarity to the motor to, in turn, reverse the direction of rotation of the wheel assemblies.

12. The hand-held device for shredding paper as set forth in claim 11, wherein also including a transparent, resilient packaging covering that allows movement of the reversing switch when operated within the package, and returns the reversing switch to its normal position when released.

* * * * *